US005492175A

United States Patent [19]

El-Rabaa et al.

[11] Patent Number: 5,492,175

[45] Date of Patent: Feb. 20, 1996

[54] METHOD FOR DETERMINING CLOSURE OF A HYDRAULICALLY INDUCED IN-SITU FRACTURE

[75] Inventors: A. Wadood El-Rabaa, Plano; Connie R. Woehr, Carrollton, both of Tex.

[73] Assignee: Mobil Oil Corporation, Fairfax, Va.

[21] Appl. No.: 370,274

[22] Filed: Jan. 9, 1995

[51] Int. Cl.[6] ..... E21B 43/26

[52] U.S. Cl. ..... 166/250.01; 73/155; 166/308

[58] Field of Search ..... 166/300, 308, 166/250; 73/151, 155

[56] References Cited

U.S. PATENT DOCUMENTS

| | | | |
|---|---|---|---|
| 3,965,982 | 6/1976 | Medlin | 166/249 |
| 4,067,389 | 1/1978 | Savins | 166/246 |
| 4,378,845 | 4/1983 | Medlin et al. | 166/297 |
| 4,393,933 | 7/1983 | Nolte et al. | 166/250 |
| 4,515,214 | 5/1985 | Fitch et al. | 166/250 |
| 4,549,608 | 10/1985 | Stowe et al. | 166/280 |
| 4,687,061 | 8/1987 | Uhri | 166/308 |
| 4,858,130 | 8/1989 | Widrow | 166/250 X |
| 5,206,836 | 4/1993 | Holzhausen et al. | 73/155 X |
| 5,327,971 | 7/1994 | Garbutt et al. | 166/250 |
| 5,353,637 | 10/1994 | Plumb et al. | 166/250 X |

*Primary Examiner*—George A. Suchfield

*Attorney, Agent, or Firm*—Alexander J. McKillop; George W. Hager, Jr.

[57] ABSTRACT

A subsurface formation surrounding a borehole is hydraulically fractured when a fracturing fluid is supplied down through the borehole by way of a fluid injection line from the surface of the earth. Pressure drop is measured along the injection line as fracturing fluid flows therethrough. Both fracture closure and minimum in-situ stress are determined at the point where such pressure drop is equal only to a hydrostatic pressure difference along the injection line.

10 Claims, 2 Drawing Sheets

METHOD FOR DETERMINING CLOSURE OF A HYDRAULICALLY INDUCED IN-SITU FRACTURE

BACKGROUND OF THE INVENTION

The present invention relates to hydraulic fracturing of subterranean formations and more particularly, to the monitoring of the closure of a hydraulically induced fracture and determination of the minimum in-situ stress.

During the completion of wells drilled into the earth, a string of casing is normally run into the well and a cement slurry is flowed into the annulus between the casing string and the wall of the well. The cement slurry is allowed to set and form a cement sheath which bonds the string of casing to the wall of the well. Perforations are provided through the casing and cement sheath adjacent the subsurface formation. Fluids, such as oil or gas, are produced through these perforations into the well.

Hydraulic fracturing is widely practiced to increase the production rate from such wells. Fracturing treatments are usually performed soon after the formation interval to be produced is completed, that is, soon after fluid communication between the well and the reservoir interval is established. Wells are also sometimes fractured for the purpose of stimulating production after significant depletion of the reservoir.

Hydraulic fracturing techniques involve injecting a fracturing fluid down a well and into contact with the subterranean formation to be fractured. Sufficiently high pressure is applied to the fracturing fluid to initiate and propagate a fracture into the subterranean formation. Proppant materials are generally entrained in the fracturing fluid and are deposited in the fracture to hold the fracture open.

In conventional hydraulic fracturing as practiced by industry, the direction of fracture propagation is primarily controlled by the present orientation of the subsurface ("in-situ") stresses. These stresses are usually resolved into a maximum in-situ stress and a minimum in-situ stress. The two stresses are mutually perpendicular (usually in a horizontal plane) and are assumed to be acting uniformly on a subsurface formation at a distance greatly removed from the site of a hydraulic fracturing operation (i.e., they are "far-field" in-situ stresses). The direction that a hydraulic fracture will propagate from a wellbore into a subsurface formation is perpendicular to the least principal in-situ stress.

Several such hydraulic fracturing methods are disclosed in U.S. Pat. Nos. 3,965,982; 4,067,389; 4,378,845; 4,515,214; 4,549,608, and 4,687,061 for example. This invention is related to the determination of the magnitude of the least principal in-situ stress and detection of fracture closure time.

SUMMARY OF THE INVENTION

The present invention is directed to a method for monitoring the hydraulic fracture closure in a subsurface formation. More particularly, fracturing fluid is hydraulically applied to a subsurface formation surrounding a borehole by way of a fluid injection line extending down through the borehole from the surface of the earth. Pressure drop is measured along the fluid injection line as fracturing fluid flows through the injection line during fracturing of the subsurface formation. Fracture closure is identified when the measured pressure drop along the fluid injection line is equal only to a hydrostatic pressure difference.

In a more specific aspect, the pressure drop along the fluid injection line is measured by a pair of fluid pressure transducers at spaced-apart positions along the fluid injection line. Pressure profiles are plotted for the pair of pressure measurements. Both fracture closure and minimum in-situ stress are determined from the point where the pair of pressure profiles overlap after excluding the hydrostatic pressure difference.

DESCRIPTION OF THE PREFERRED EMBODIMENT

Figure 1:
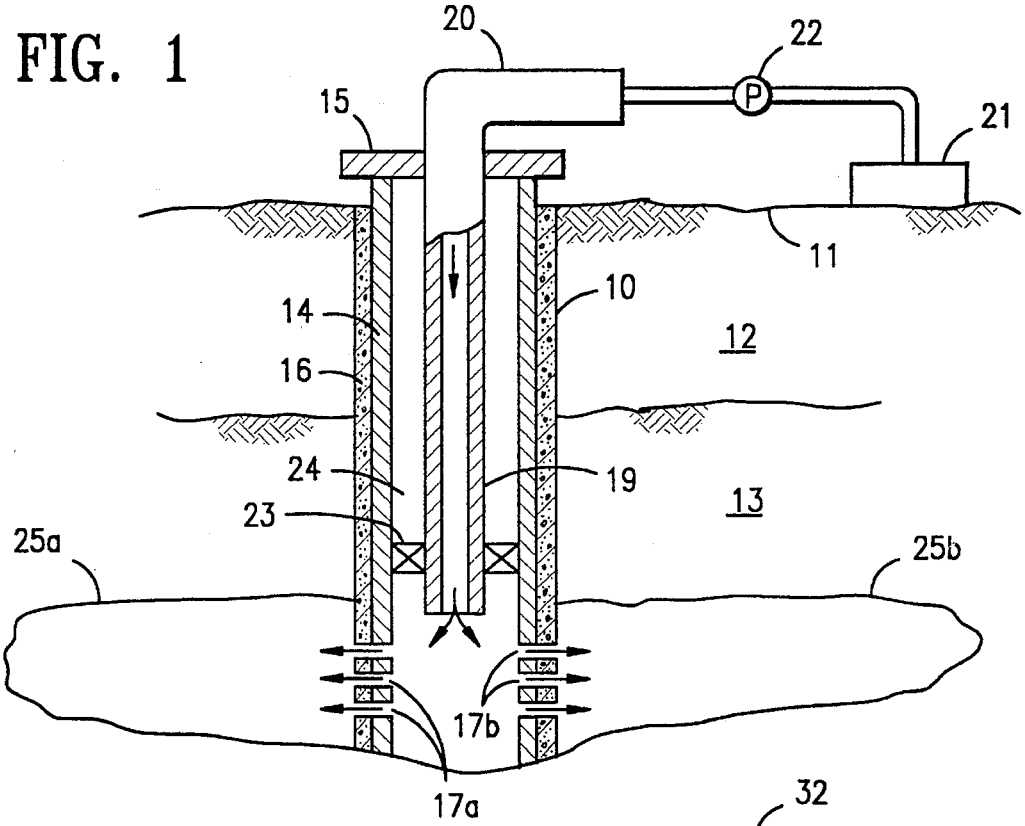
FIG. 1 illustrates a formation fracturing system useful in carrying out the method of the present invention.

Referring initially to FIG. 1, there is shown formation fracturing apparatus with which the method of the present invention may be carried out. A wellbore 10 extends from the surface 11 through an overburden 12 to a productive formation 13 where the in-situ stresses favor a vertical fracture. Casing 14 is set in the wellbore and extends from a casing head 15 to the productive formation 13. The casing 14 is held in the wellbore by a cement sheath 16 that is formed between the casing 14 and the wellbore 10. The casing 14 and cement sheath 16 are perforated at **17*a* and 17*b* where the local in-situ stresses favor the propagation of vertical fractures. Perforations 17*a* are preferably spaced 180° from perforations 17*b* and are aligned with fracture direction, if known. An injection line 19 is positioned in the wellbore and extends from the casing head 15 into the wellbore to a point above the perforations 17. The upper end of injection line 19 is connected by a conduit 20 to a source 21 of fracturing fluid. A pump 22 is provided in communication with the conduit 20 for pumping the fracturing fluid from the source 21 down the injection line 19. A packer 23 is placed in the annulus 24 above the lower end of the injection line 19**.

In carrying out a hydraulic fracturing operation, the pump 22 is activated to force fracturing fluid down the injection line 19 and out the perforations **17*a* and 17*b* (as shown by arrows) into the formation 13 for the purpose of initiating and propagating the vertical fractures 25*a* and 25*b***.

Figure 2:
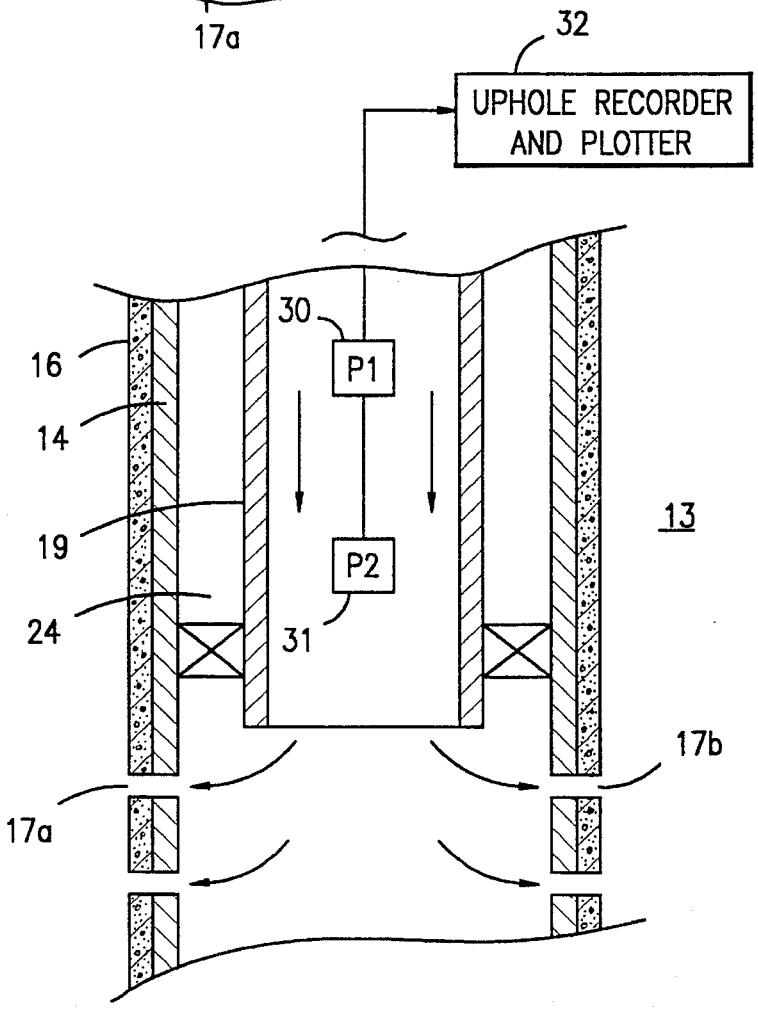
FIG. 2 illustrates a pair of pressure transducers used with the system of FIG. 1 to carry out in-situ pressure readings within the fracturing system of FIG. 1.

It is a specific feature of the present invention to determine closure of the hydraulically induced fractures **25*a* and 25*b* from pressure readings taken along injection line 19 as shown in FIG. 2. This determination does not require the conventional plotting procedures in which a plot of the pressure fall-off function vs. some type of time function is used to determine fracture closure and minimum in-situ stress. Instead, the novelty of the present invention's procedure relies on the existence of pressure drop along the injection line 19 as fracturing fluid flows down the line as shown by the arrows. The pressure difference measured between the two points P1 and P2, as measured by the pair of pressure transducers 30 and 31 respectively, in the injection line 19** is caused by pipe friction and head pressure. For a vertical well, and a Newtonian fluid, this can be expressed as follows:

$$P1-(P2+h)=k(\mu LQ/D^4) \quad (1)$$

where, P1 and P2: line pressure readings from the two pressure transducers 30 and 31 respectively, h: hydrostatic head caused by fluid weight between two points P1 and P2, μ: fluid viscosity, Q=fluid flowrate, L=distance between P1 and P2, D=diameter of injection line, and k=constant depends on units used.

Figure 3:
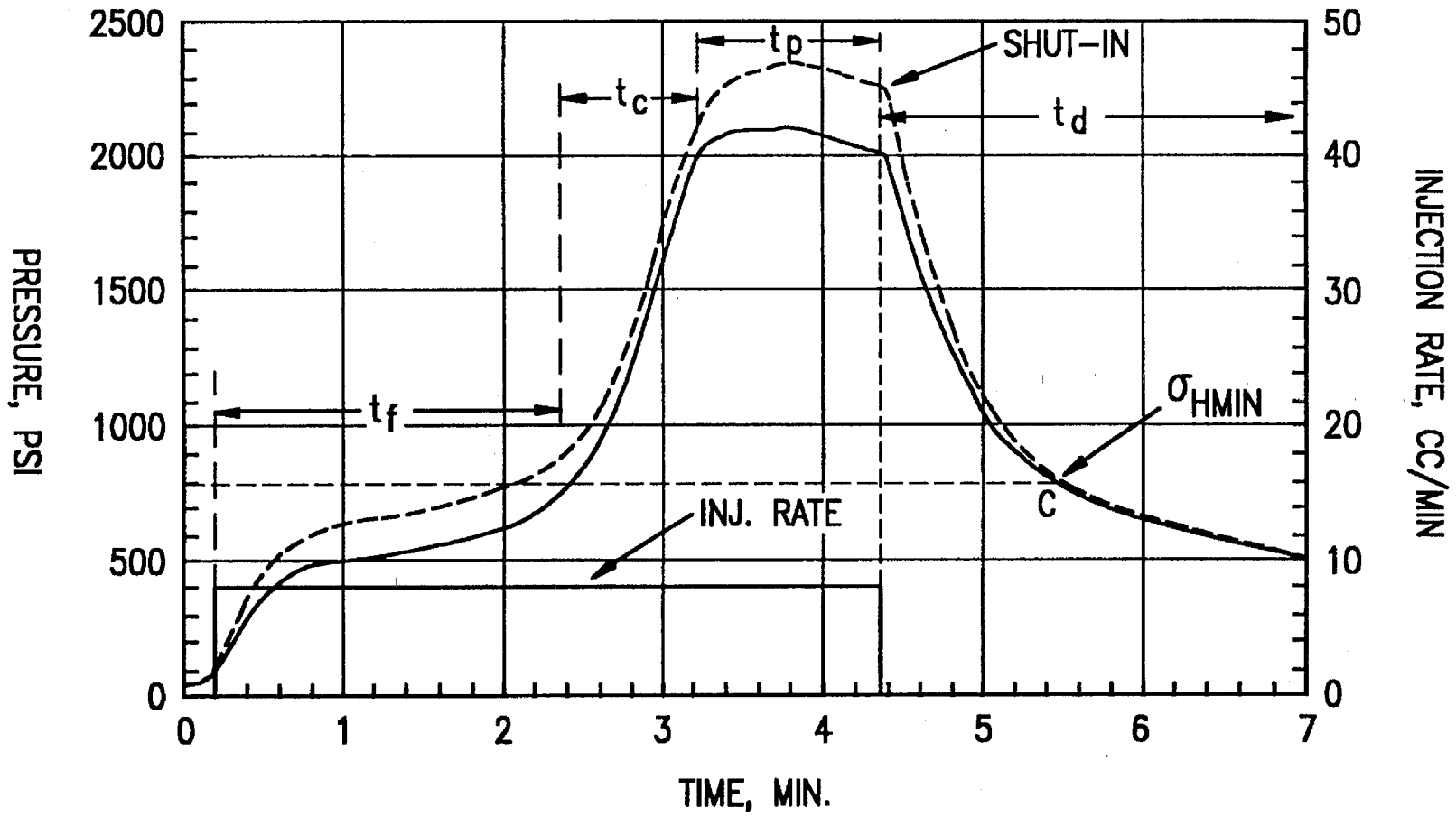
FIG. 3 is a plot of differential pressure readings taken by the pair of pressure transducers of FIG. 2 for use in determining closure of a hydraulically induced fracture in accordance with the method of the present invention.

By recording and plotting the pressure readings P1 and P2 on the uphole recorder and plotter 32 in the form of the plot as shown in FIG. 3, the difference between the P1 and P2 curves can be used directly as an accurate diagnostic tool to describe the downhole system behavior including fracture opening and closing. Whenever the fracture is extending or is still open, a pressure difference between P1 and P2 exists, indicating that fluid is still flowing in the injection lines and Q in eq.(1) is greater than zero. Upon shut-in the fracture closes and fluid flow in the injection line is stopped, Q=O, and the difference between P1 and P2 is equal to the hydrostatic pressure only (i.e., fluid density× distance).

FIG. 3 illustrates two pressure profiles recorded during a hydraulic fracture test. FIG. 3 encompasses four stages during the test in which the minimum stress applied is 800 psi. The four time periods, $t_f$, $t_c$, $t_p$ and $t_d$, correspond to:

$t_f$=time it takes to fill the tubing, two transducers P1 and P2 show different readings, $t_c$=time it takes for fluid in wellbore to compres, very slow fluid motion, no friction, and fluid flow only for wellbore leakoff, $t_p$=fracture propagation period, transducers P1 and P2 show different readings due to fluid flow, and $t_d$=fracture closure and pressure decline period, pressure transducers readings are merging, indicating diminishing flow into the fracture.

During periods in which fluid flow in the line is minimum, as in $t_c$ and $t_d$, pressure drop is small (i.e., P1 is very close to P2). When the fracture closes, fluid in the injection line is no longer in motion, and there is no friction. Thus, P1 is approximately equal to P2 when hydrostatic head is negligible (P1 is at the level of P2), and pressure profiles overlap starting from fracture closure time. The starting of pressure profile overlap in FIG. 3 is the closure point C, which corresponds to a pressure of 800 psi or the known applied minimum in-situ stress in the test (i.e., no flow, no friction, P1 and P2 readings overlap). The accuracy of the technique increases as the line friction drop increases.

By examining eq.(1), friction can be increased by the following:

i) using smaller diameter injection lines, ii) using more viscous fluids, and iii) using higher injection rates.

Even though placing a greater distance between P1 and P2 can increase pressure drop, it is not recommended because greater hydrostatic head can offset pressure drop due to friction in vertical low flow rate tests.

In carrying out the hydraulic fracturing method of the present invention, the techniques and systems disclosed in the aforementioned U.S. Patents may be employed, the teachings of which are incorporated herein by reference. Suitable pressure transducers for use in such systems should have a range above the expected fracturing gradient and an accuracy of 0.5% or better. Pressure transducers with dial type readouts are not recommended. (Strain gage type pressure transducers manufactured by Sensotec with a range of 0–10,000 psi and an accuracy of 0.5% were used in experiments conducted to verify the method. Recordings are shown in FIG. 3.)

What is claimed is:

1. A method for monitoring the hydraulic fracturing of a subsurface formation comprising the steps of:

a) hydraulically fracturing a subsurface formation surrounding a borehole with a fracturing fluid applied to the subsurface formation by way of a fluid injection line extending down through the borehole from the surface of the earth, b) measuring pressure at a pair of spaced-apart positions along the fluid injection line as fluid flows through said injection line during fracturing of the subsurface formation, c) shutting off the flow of fracturing fluid through the injection line to the subsurface formation, and d) identifying fracture closure when there is only a hydrostatic pressure difference between said pair of pressure measurements.

2. The method of claim 1 wherein step (d) comprises the steps of:

a) plotting pressure profiles of the pair of pressure measurements, and b) identifying fracture closure at the point where the pair of pressure profiles overlap excluding hydrostatic pressure difference.

3. The method of claim 2 further comprising the step of identifying minimum in-situ stress at the point where the pair of pressure profiles overlap excluding hydrostatic pressure difference.

4. A method for determining fracture closure following the in-situ fracturing of a subsurface formation comprising the steps of:

a) hydraulically fracturing a subsurface formation surrounding a borehole with a fracturing fluid applied to the subsurface formation by way of a fluid injection line extending down through the borehole from the surface of the earth, b) measuring pressure drop along the fluid injection line as fracturing fluid flows through said injection line during fracturing of the subsurface formation, c) measuring hydrostatic pressure along said injection line, d) shutting off the flow of fracturing fluid through said injection line to said subsurface formation, and e) identifying the point of fracture closure when said pressure drop along the fluid injection line is equal only to said hydrostatic pressure.

5. The method of claim 4 wherein said pressure drop and said hydrostatic pressure are determined for a pair of spaced-apart positions along said fluid injection line.

6. The method of claim 5 wherein said pressure drop is determined by measuring fluid pressure at said pair of spaced-apart positions with a pair of fluid pressure transducers.

7. The method of claim 5 wherein said pressure drop is expressed as:

$$P1-(P2+h)=k(\mu LQ/D^4)$$

where,

P1 and P2=fluid pressure readings at a select pair of spaced apart-positions along the fluid injection line, h=hydrostatic head caused by fluid weight between said pair of spaced-apart positions along the fluid injections line, μ=fluid viscosity, Q=fluid flow rate, L=distance between P1 and P2, D=diameter of injection line, and k=constant.

8. The method of claim 6 further comprising the step of plotting pressure profiles of the pair of spaced-apart pressure transducers.

9. The method of claim 8 wherein fracture closure is determined at the point where the pair of pressure profiles overlap excluding hydrostatic pressure difference.

10. The method of claim 8 wherein minimum in-situ stress is determined at the point where the pair of pressure profiles overlap excluding hydrostatic pressure difference.

* * * * *